US010166428B2

(12) United States Patent
Giafardino

(10) Patent No.: US 10,166,428 B2
(45) Date of Patent: Jan. 1, 2019

(54) ADJUSTABLE CLUB

(71) Applicant: Donald Giafardino, Deerfield Beach, FL (US)

(72) Inventor: Donald Giafardino, Deerfield Beach, FL (US)

( * ) Notice: Subject to any disclaimer, the term of this patent is extended or adjusted under 35 U.S.C. 154(b) by 14 days.

(21) Appl. No.: 15/375,621

(22) Filed: Dec. 12, 2016

(65) Prior Publication Data

US 2017/0282003 A1 Oct. 5, 2017

Related U.S. Application Data

(60) Provisional application No. 62/318,084, filed on Apr. 4, 2016.

(51) Int. Cl.

| | |
|---|---|
| ***A63B 21/075*** | (2006.01) |
| ***A63B 21/00*** | (2006.01) |
| ***A63B 15/00*** | (2006.01) |
| ***A63B 21/06*** | (2006.01) |
| ***A63B 21/072*** | (2006.01) |
| *A63B 23/04* | (2006.01) |
| *A63B 71/06* | (2006.01) |

(52) U.S. Cl.

CPC ..... *A63B 21/075* (2013.01); *A63B 15/00* (2013.01); *A63B 21/0607* (2013.01); *A63B 21/072* (2013.01); *A63B 21/4035* (2015.10); *A63B 2023/0411* (2013.01); *A63B 2071/0625* (2013.01); *A63B 2207/02* (2013.01); *A63B 2220/80* (2013.01)

(58) Field of Classification Search

CPC ..... A63B 21/075; A63B 21/00065; A63B 21/4035; A63B 23/0405; A63B 71/0622; A63B 2023/0411

See application file for complete search history.

(56) References Cited

U.S. PATENT DOCUMENTS

| | | | | |
|---|---|---|---|---|
| 181,884 | A | 9/1876 | Welch | |
| 259,752 | A | 6/1882 | Fidher | |
| 675,314 | A | 5/1901 | Abenheim | |
| 1,026,990 | A | 10/1910 | Matson | |
| 1,603,904 | A | 10/1926 | Edward | |
| 3,342,489 | A * | 9/1967 | Waldo | A63D 15/08 273/129 R |
| 3,861,682 | A | 1/1975 | Fujii | |
| 4,021,040 | A | 5/1977 | Inoue | |
| 4,819,935 | A | 4/1989 | Dirksing et al. | |
| 5,312,308 | A | 5/1994 | Hamilton et al. | |
| 5,407,413 | A * | 4/1995 | Kupferman | A63B 21/0728 482/106 |
| 6,692,386 | B2 | 2/2004 | Brundage | |
| D492,373 | S | 6/2004 | Sonnon et al. | |
| 6,939,237 | B1 * | 9/2005 | Voden | A63D 15/08 473/44 |
| 7,557,286 | B2 * | 7/2009 | Capotosto | A63B 15/00 482/109 |

(Continued)

*Primary Examiner* — Megan Anderson

(74) *Attorney, Agent, or Firm* — Allen F. Bennett; Bennett Intellectual Property

(57) ABSTRACT

An adjustable club for exercise that has an elongate handle, at least one weight and a stud. The elongate handle acts as a counterweight to the removable weights. The elements of the adjustable club may be held together by two different types of frictional fits. The adjustable club may include only the elongate handle and the stud.

8 Claims, 9 Drawing Sheets

(56) References Cited

U.S. PATENT DOCUMENTS

| | | | | |
|---|---|---|---|---|
| 8,821,323 | B2 * | 9/2014 | Liu | A63B 69/0002 473/422 |
| 8,951,172 | B2 * | 2/2015 | Marcus | A63B 21/075 482/106 |
| 2005/0200136 | A1 * | 9/2005 | Aisenbrey | B29C 45/0013 292/1 |
| 2008/0202317 | A1 | 8/2008 | Capotosto | |

* cited by examiner

ADJUSTABLE CLUB

CROSS-REFERENCE TO RELATED APPLICATIONS

This application is a Utility Patent Application and claims priority to U.S. Provisional Application Ser. No. 62/318,084 filed on Apr. 4, 2016, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to an adjustable club for use in exercise or art. More particularly, the invention relates to an adjustable club that embodies the benefits of a traditional club with added versatility and effectiveness.

Background of the Invention

It is well known that Indian Clubs, as they are commonly called, have been around for hundreds of years. The earliest known origin of the wooden club is the Middle East. From here the wooden club was introduced to other parts of the world including Asia and India. In the Nineteenth Century, British soldiers, stationed in India, took note of the impressive physique of Indian soldiers. Interest in the muscular physique, of the Indian soldiers, led the British to the discover that it was practice with wooden clubs which had caused their notable physical fitness. The British then coined the phrase "Indian club" though the wooden club had its origin in the Middle East and was previously known as Meels.

The British author, Donald Walker, is credited with introducing the Indian Club to Europe and the United States. The Indian Club became popular with both the military, gymnasts and even lay women. Walker created exercises with scepters, a smaller version of the traditional club, geared toward women. In the 1920s however, increased popularity in sports caused a decrease in the popularity of the Indian Club. In modern times, some physical fitness enthusiast have begun to reignite the passion for the benefits enjoyed by a routine practice with the Indian club.

A routine practice with the Indian Club has many well-known benefits and applications. The use of light weight clubs promotes balance and agility. Use with very heavy clubs promotes strength and muscle gain. Strategic use of the club may also promote skeletal alignment. The clubs are swung in strategic sequences and choreographed routines. Such practice with Indian Clubs may be considered an art form. For example, Jori swinging may be considered not just a form of exercise but also an art.

The wooden club still exists. There have been various modifications made to the club over time. Inventors have attempted to combine clubs with dumbbells. Others have added stationary or removable weight at one end or both ends of a Club-like exercise tool or bat. Others have created chambers within the club-like tool to place weights into or to leave hollow or a combination of both. Unfortunately, these modifications forfeit the look, feel, and full benefit of a traditional club.

The weight of the traditional wooden club is more uniformly distributed throughout the club. It is the shape and weight of the club that produces the results enjoyed by users for hundreds of years. A user that desires the routine practice and the results that come with a traditional club will have to acquire several traditional clubs of varying weights and lengths. This reality is costly. Not only is there a cost to purchasing multiple clubs but there is also a cost of added weight when shipping multiple clubs. Further, this is inconvenient to the user, as storage of multiple clubs may become impractical.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the detailed description.

In view of the foregoing, it is desirable to provide a modern club that retains the important attributes and benefits of the traditional club, while at the same time allows adjustability and versatility in length and weight.

BRIEF SUMMARY OF THE INVENTION

Accordingly, the primary object of the present invention is to provide the user with a modern club that exhibits the important qualities of the traditional club, those being the shape, the feel, and the proportionate distribution of weight; while at the same time, providing the user with the option to adjust the weight and length of the adjustable club. This results in ease of use, efficiency in training and versatility in the results that the user may obtain from the use of just one adjustable club.

In one embodiment, in accordance with the principles of the invention the adjustable club may be manufactured from any suitable metal, wood, carbon fiber or plastic. The elongate handle of the adjustable club acts as a counterweight to the cylindrical weights that may be optionally added to the handle. Optionally, the elongate handle may not act as a counterweight. In this embodiment, the adjustable club has at least one cylindrical weight. The cylindrical weights should increase in weight increments that promote the feel and uniformity of weight distribution embodied in a traditional club. The cylindrical weights have at least one dowel on one side and match to fit the receiving holes on the other side. The cylindrical weights fit into one another, dowel to receiving hole. In the same way, the cylindrical weight is designed to fit into the elongate handle when the at least one dowel of the cylindrical weight aligns with and enters the at least one receiving hole of the elongate handle. In this embodiment, a second friction fit is accomplished through a stud that enters through a centrally located bore in the cylindrical weight that was last added to the elongate handle. The stud continues longitudinally through the centrally located bore of each added cylindrical weight and then screws into the threaded bore located in the opening at the distal end of the elongate handle. The end cap on the distal end of the stud acts to cap off the distal end of the adjustable club. This embodiment allows the user to remove or add weight and length as desired.

In another embodiment, the adjustable club comprises an elongate handle acting as a counterweight and a stud with an end cap. Optionally, the elongate handle may not act as a counterweight. The two elements lock where the stud screws into the threaded bore located in the opening at the distal end of the elongate handle. This embodiment may optionally include a friction, where the proximal side of the end cap has at least one dowel and the distal end of the elongate handle has at least one receiving hole configured to fit with the dowel. This embodiment may optionally have a weighted end cap. This embodiment resembles a scepter. The weighted end cap or the counterweight may be interchangeable with various other weighted end caps or counterweights. This embodiment retains some variety in the fitness objectives that may be achieved by the user but may limit the amount of weight that may be added.

It is therefore an object of the present invention to provide an adjustable club that affords the user every relevant characteristic of the traditional club with greater efficiency and versatility in weight, length, and objective.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
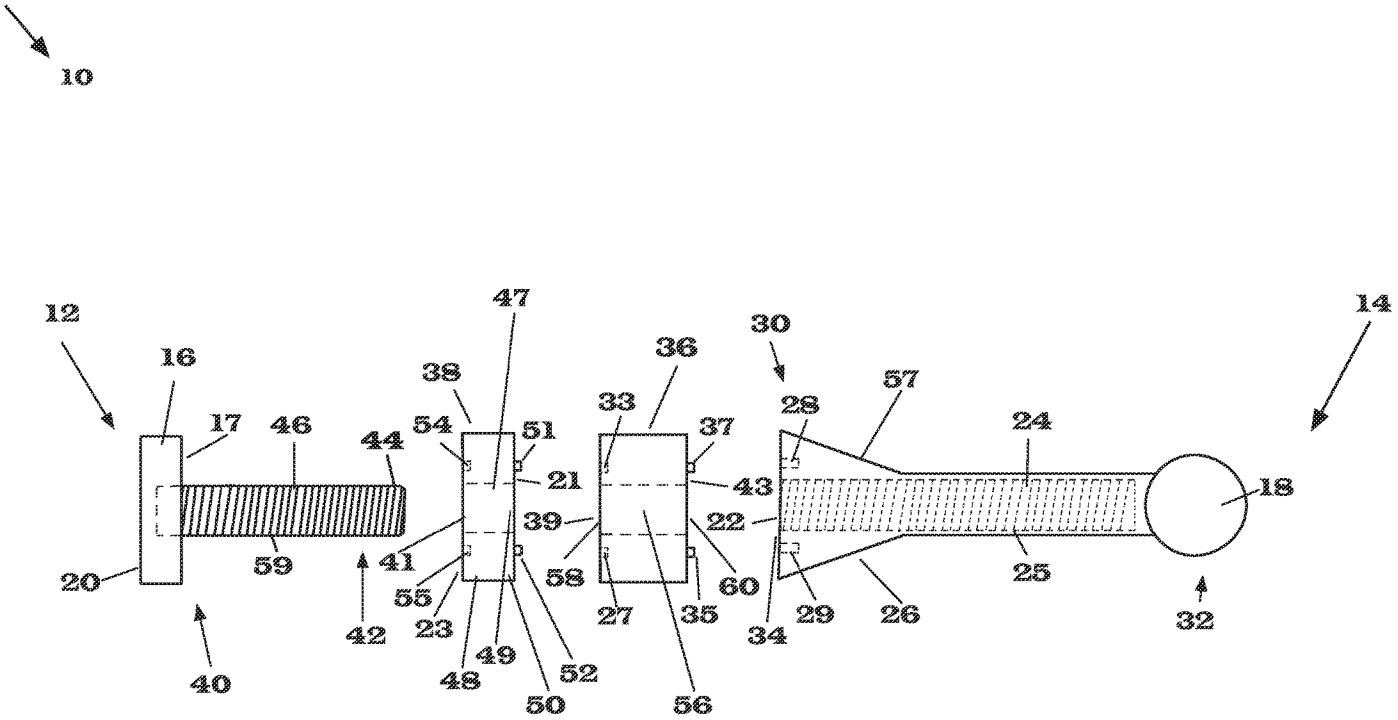
FIG. 1 is an exploded view of an adjustable club in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Disclosed is an adjustable club for use in exercise or art in accordance with the principles of the invention. The adjustable club allows weight to be added to or removed from the club.

FIG. 1 shows an embodiment of the adjustable club 10, in accordance with the principles of the invention, having an elongate handle 25 located at the proximal region 14, a stud 46 located at the distal region 12, and two removable weights 38 and 36 located at the distal end 34 of the elongate hand 25 and at the proximal end 44 of the stud 46. The elongate handle 25 has a proximal region 32 and a distal region 30. The Distal region 30 has a distal end 34. At the distal end 34 there is an opening 22 to a threaded bore 24 that extends in the direction of the proximal end 18 of the elongate handle 25 and along the longitudinal axis of the elongate handle 25. Optionally, the threading of the bore may begin at any point along the longitudinal axis of the elongate handle 10 or the bore may not be threaded at all and instead a ratchet or other mechanism may be used to secure engagement of the elongate handle 25 to the stud 46. The distal end 34 of the elongate handle 25 has two receiving holes 28 and 29. The distal region 30 of the elongate handle 25 has a frustoconical configuration 26 tapering outwardly in a distal direction. The elongate handle 25, in its entirety acts as a counterweight 57. Optionally, the elongate handle may not act as a counterweight In this embodiment, the first weight 36 located at the distal end 34 of the elongate handle 25 has a proximal end 43 and a distal end 39. Located at the proximal end 43 are two dowels 37 and 35 that are configured to fit with the receiving holes 28 and 29. Optionally, there may be one or more dowels or one or more receiving holes. The use of more than one receiving hole and dowel, may increase the security and efficiency in the prevention of rotational movement. When the dowels 37 and 35 engage the receiving holes 28 and 29 this causes a friction fit that prevents rotational movement and causes the distal end 34 of the elongate handle 25 to be flush with the proximal end 43 of the first weight 36. At the distal end 39 of the weight 36 are two receiving holes 27 and 33. This embodiment contains a centrally located bore 56 extending from a first opening 60 at the proximal end 43 of the weight 36 to a second opening 58 located at the distal end of the weight 36.

In this embodiment, the second weight 38 has a proximal end 21 and a distal end 23. Located at the proximal end 21 are two dowels 51 and 52 that are configured to fit with the receiving holes 27 and 33 located on the distal end 39 of the first weight 36. Located at the distal end 23 of the second weight 38 are two receiving holes 54 and 55. When the dowels 51 and 52 engage with the receiving holes 33 and 27 this creates a friction fit that prevents rotational movement. Optionally, there may be one or more dowels or one or more receiving holes. The use of more than one receiving hole and dowel, may increase the security and efficiency in the prevention of rotational movement. The second weight 38 has a centrally located bore 47 extending from a first opening 49 at the proximal end 21 of the weight 38 to a second opening 41 at the distal end 23 of the weight 38. In this embodiment, the weights 38 and 36 are different lengths. Optionally, it may be desirable to have weights of the same length.

The stud 46, located at the distal region 12 of the club 10 has a proximal end 44 and a distal end 20. Located at the distal end 20 is an end cap 16 having a proximal end 17. At the proximal end 17 of the end cap is a rod 59. The rod 59 is configured to fit through the centrally located bores 47 and 56 of the weights 38 and 36 and to engage with the threaded bore 24 of the elongate handle 25. When the rod 59 engages the threaded bore 24 this prevents longitudinal and rotational movement. In this embodiment, the rod 59 is threaded to engage with a threaded bore 24. Optionally, the rod may be smooth and may engage with a smooth bore of an elongate handle and an additional locking mechanisms may be used to prevent longitudinal movement.

The adjustable club 10 may be manufactured from any suitable material that is used in the weight lifting industry. It may be desirable to use a material having properties of rigidness and durability found in materials such as metal, wood, carbon fiber, or plastic. Metal will provide durability in use and will keep the integrity of the clubs 10 shape. Metal allows for a substantial increase and versatility in weight. It may be desirable to use wood. Wood allows the user to harken back to the traditional club in both esthetics and results. Wood may be more desirable when the club is being used for art or a purpose other than weight training. Optionally, in this embodiment 10 the exterior of the adjustable club 10 may display any desired color or pattern.

Figure 2:
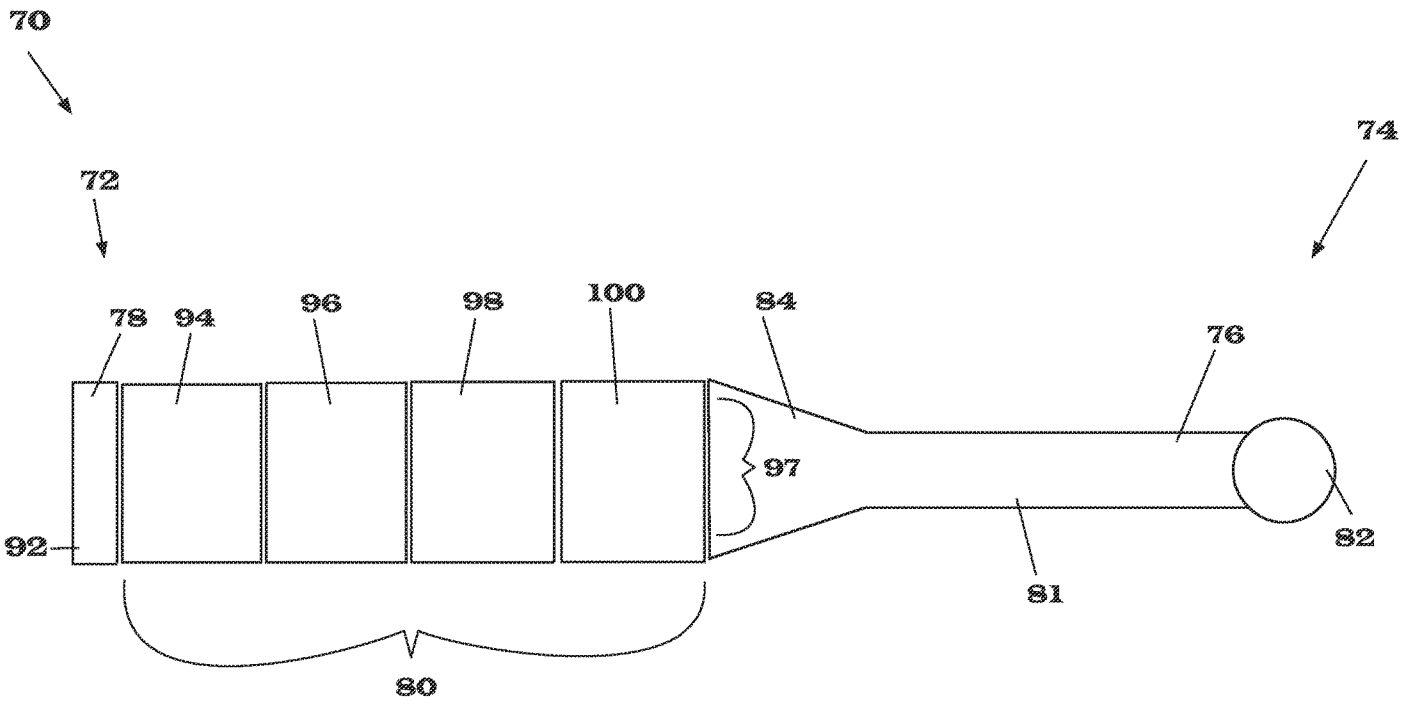
FIG. 2 is a collapsed view an adjustable club in accordance with the principles of the invention.

FIG. 2 shows an alternative embodiment, in accordance with the principles of the invention, of the club 70 with an elongate handle 76 located at the proximal region 74 of the club 70. The elongate handle 76 has a proximal end 82 and a distal end 84. Located at the distal end 84 of the elongate handle 76 are four cylindrical weights 80. Located at the distal region 72 of the club 70 is a stud 78. The stud 78 makes up the distal end 92 of the club. In this embodiment, there are four weights 80. Optionally, there may be one or more removable weights. Adding or removing the weights 80 will change the esthetics of the club 70 and will also yield different results when training. Using fewer weights 80 will promote flexibility and agility. Using more weights 80 will promote strength and muscle gain.

In this embodiment, each weight 80 and the counterweight 81 are of the same weight increment. Optionally, it may be desirable to use a set of weights of varying weight increments. For example, weight 100 may weigh 2 pounds, weight 98 may weigh 8 pounds, weight 96 may weigh 5 pounds and weight 94 may weigh 3 pounds. Optionally, it may be desirable to have a set of weights 80, each of equal weight such that a user may increase or decrease the weight incrementally. For example, the weights 94, 96, 98, and 100 and the counterweight 81 may each weigh 2.5 pounds.

When the weight increments of the weights 80 are, the same or are close in weight to the counterweight 81, the distribution of weight throughout the surface area of the adjustable club is even. Thus, the center of gravity is distally and longitudinally down shifted about the club with the addition of each weight 94, 96, 98 and 100. For example, if the counterweight 81 is 2.5 pounds and a weight 94 of 2.5 pounds is added, the center of gravity will shift longitudinally down 50% of the club. This even distribution of weight provides benefit in exercise. In this embodiment, the weights 80 are each the same length. Optionally, the weights 80 may be of varying lengths. Keeping the weights 80 the same length and weight may evenly distribute the weight throughout the club 70.

In this embodiment, the weight 100, has a length 95 and a width 97 with an aspect ration of 0.5 and 1.5. The weights 80 are cylindrical. Optionally, one or more of the at least one weight may instead be shaped as a polygonal cross-section or a parallelepiped. Optionally, it may be desirable to keep the overall outline and shape of a traditional club.

Figure 3:
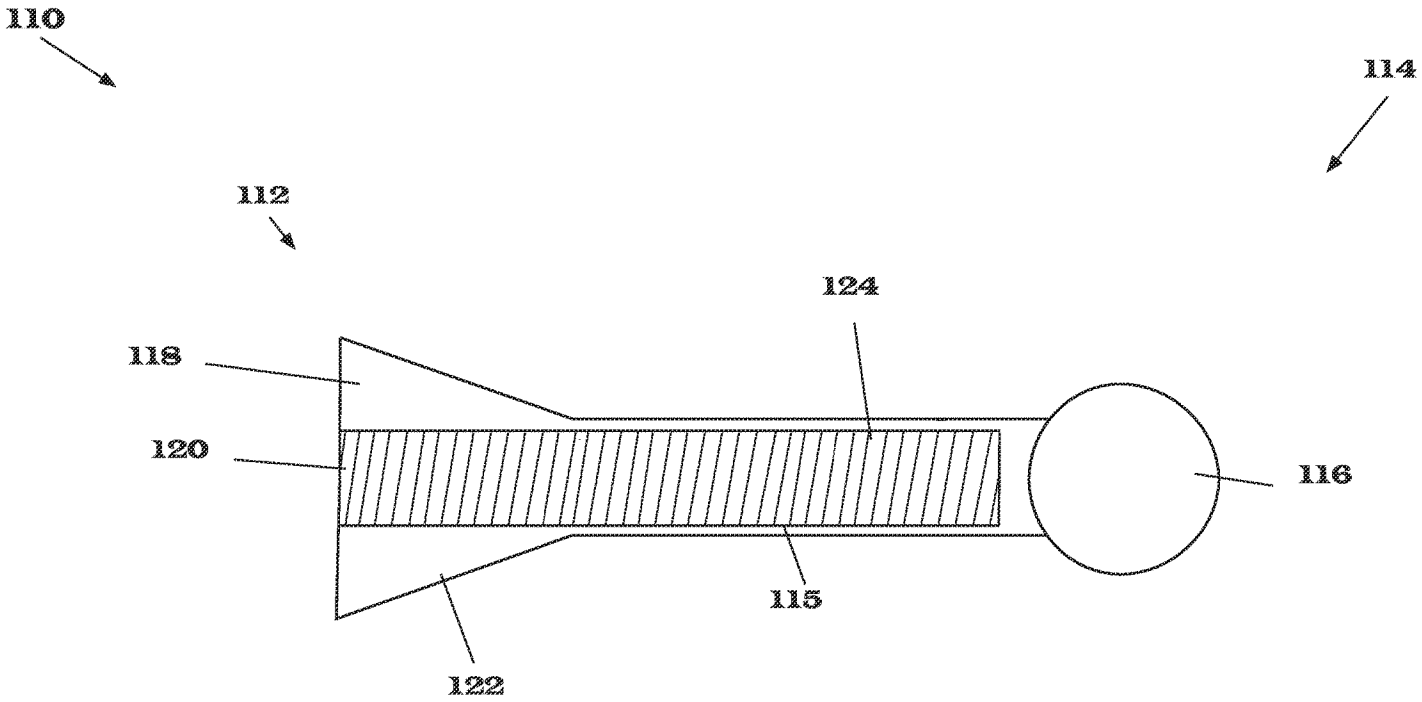
FIG. 3 is a cross-sectional view of an elongate handle in accordance with the principles of the invention.

FIG. 3 shows an embodiment of the elongate handle 110 in accordance with the principles of the invention. The elongate handle 110 has a distal region 112 and a proximal region 114. In this embodiment, the distal region 112 of the elongate handle 110 has frustoconical configuration tapering outward in a distal direction. The distal end 118 has an opening 120 to a threaded bore 124. In this embodiment, the threaded bore 124 extends along the longitudinal axis of the elongate handle 110 toward the proximal end 116 of the elongate handle 110. Optionally, the threaded bore 124 may extend a shorter or longer distance and may begin at any point along the longitudinal axis of the elongate handle 110. Optionally the threaded bore 124 may not be threaded but may instead be a bore. In this embodiment, the elongate handle 110 acts as a counterweight 115. The counterweight may be of any suitable weight to counter the weight added to the distal end 118 of the elongated handle 110. In this embodiment, there is one elongate handle 110. Optionally, it may be desirable to have plurality of interchangeable elongate handles. The elongate handles may be interchanged with other elongate handles having different increments in counterweight.

Figure 9:
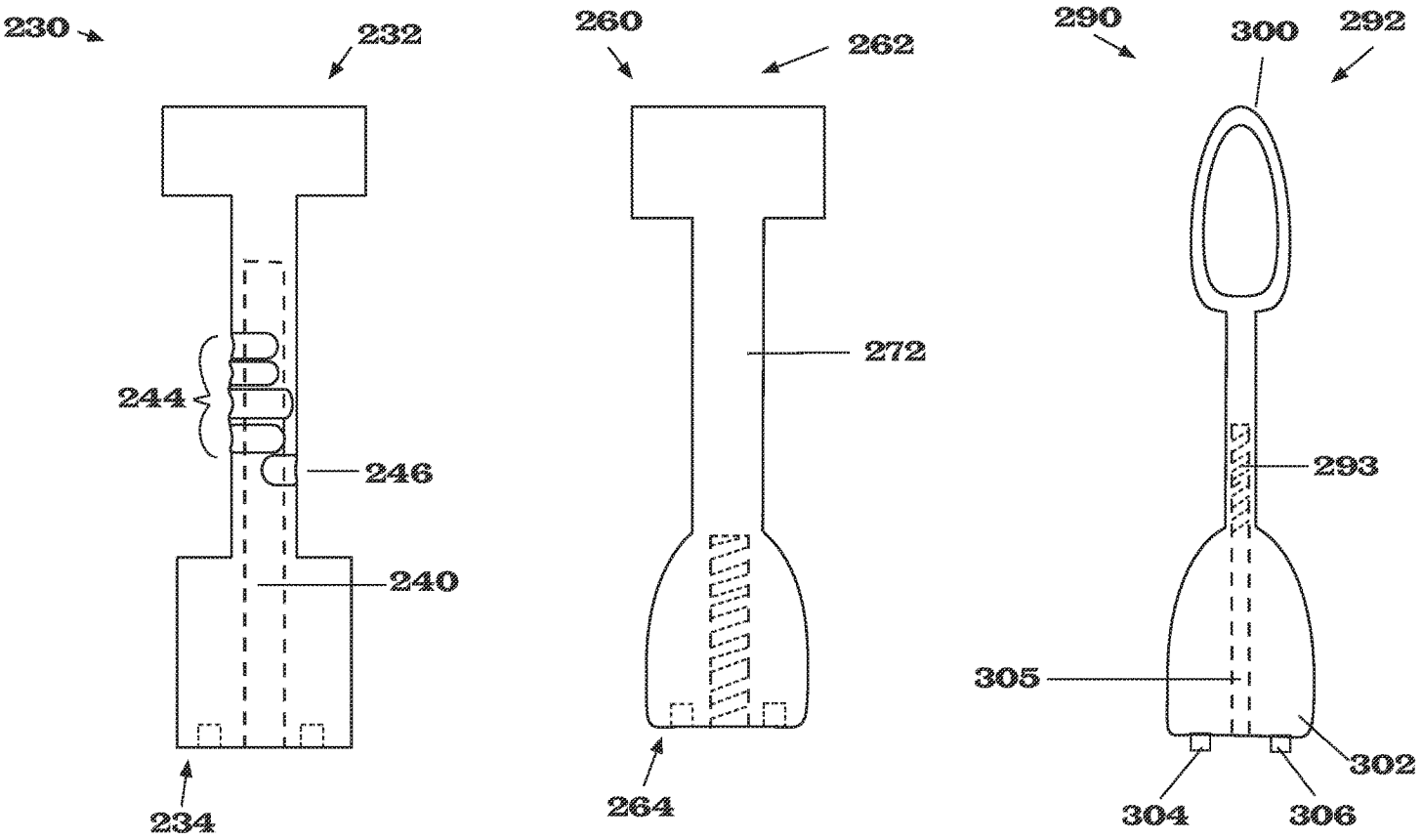
FIG. 9 is a front view of three alternative embodiments of an elongate handle in accordance with the principles of the invention.

FIG. 9 shows an alternative embodiment, in accordance with the principles of the invention, showing three different interchangeable handles 230, 260 and 292. The elongate handles 230, 260, and 292 may be any suitable length In this embodiment, the elongate handle 230 has a proximal region 232 and a distal region 234 having imprints of finger depressions 244 and 246 about the proximal region 232.

Optionally, there may be another structure for improving the gripping of the handle 232. This will create a better grip for the user as well as assist the user in hand placement. The bore 240 of the elongate handle 230 may be smooth and not threaded.

In this embodiment, the elongate handle 260 has a proximal region 262 and a distal region 264 having a grip-like or non-slip coating 272 located at the proximal region 262. This modification allows for ease of grip during use.

This embodiment shows an elongate handle 292 having a proximal end 300 and a distal end 302, having two dowels 304 and 206 located at the distal end 302. Optionally, the elongate handle 292 may have one or more dowels. The bore 305 is only partially threaded 293.

Figure 4:
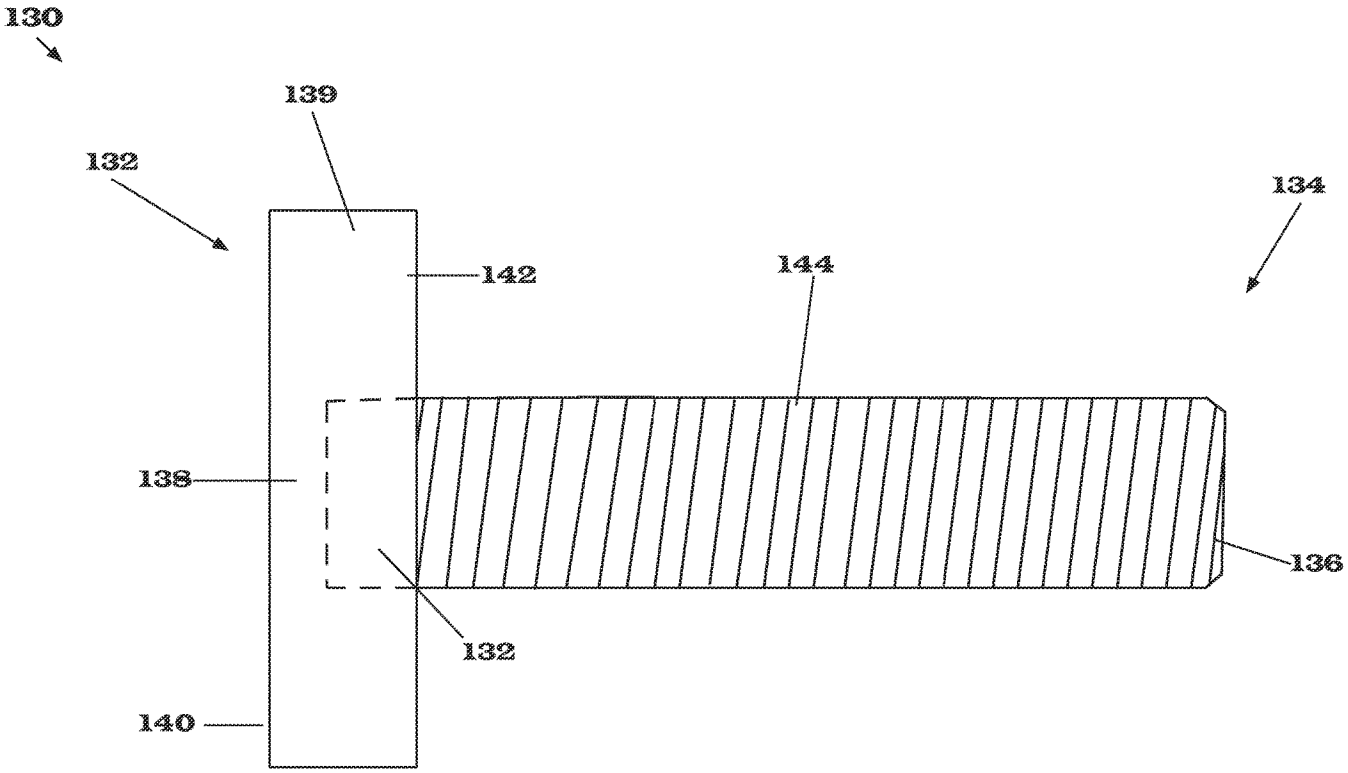
FIG. 4 is a cross-sectional view of a stud in accordance with the principles of the invention.
Figure 6:
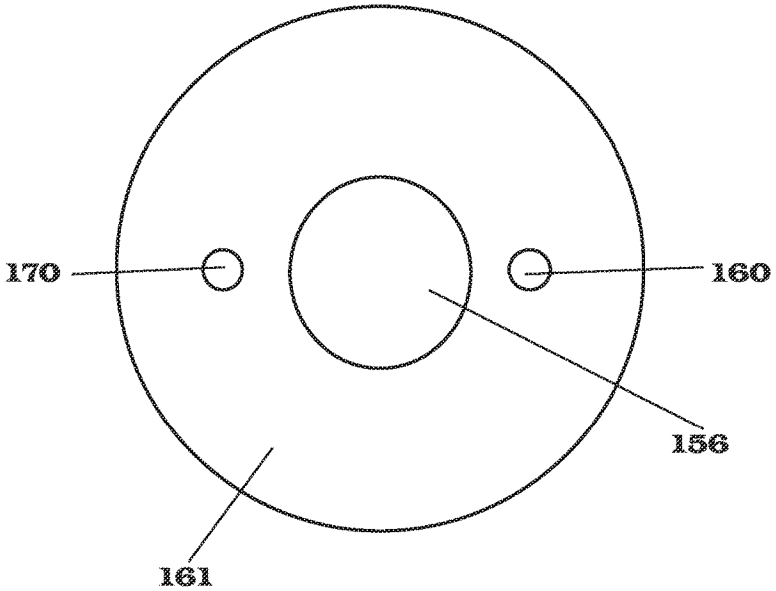
FIG. 6 is a bottom plan view of a weight in accordance with the principles of the invention.

FIG. 4 shows an embodiment of the stud 130, in accordance with the principles of the invention, having a distal region 132 and a proximal region 134. Located at the distal region 132 is an end cap 138. The end cap 138 has a distal end 140 and a proximal end 142. Located at the proximal region 134 of the stud 130 is the rod 144 having a proximal end 136 and a distal end 137. The stud 130 is configured to engage with the threaded bore 124 of the elongate handle 110. When the stud 130 and the elongate handle 110 engage, this creates a friction fit and prevents longitudinal and rotational movement. The rod 144 extends proximally. Optionally, the length of the stud 130 may be as long as necessary to engage with the threaded bore 124 of the elongate handle 110. The proximal region 134 of the stud 130 enters through the distal region 12 of the adjustable club 10.

In this embodiment, the end cap 138 acts as a closure at the distal end 11 of the adjustable club 10. The peripheral edge 139 of the end cap 138 may be gripped by user to provide leverage when affixing and removing the stud 20. In this embodiment one stud 130 is shown. Optionally, it may be desirable to have more than one interchangeable stud with end caps of varying weight. To maintain a balanced and even distribution of weight throughout club, the weight of the end cap 130 may be an increment of weight that is the same or close to that of the counterweight 81 and weights 80. In this embodiment, the end cap 138 is made from metal. Optionally, the end cap 138 may be made of any suitable material such as plastic, rubber, foam or other substance that prevents injury or damage as the club is swung by the user.

Figure 10:
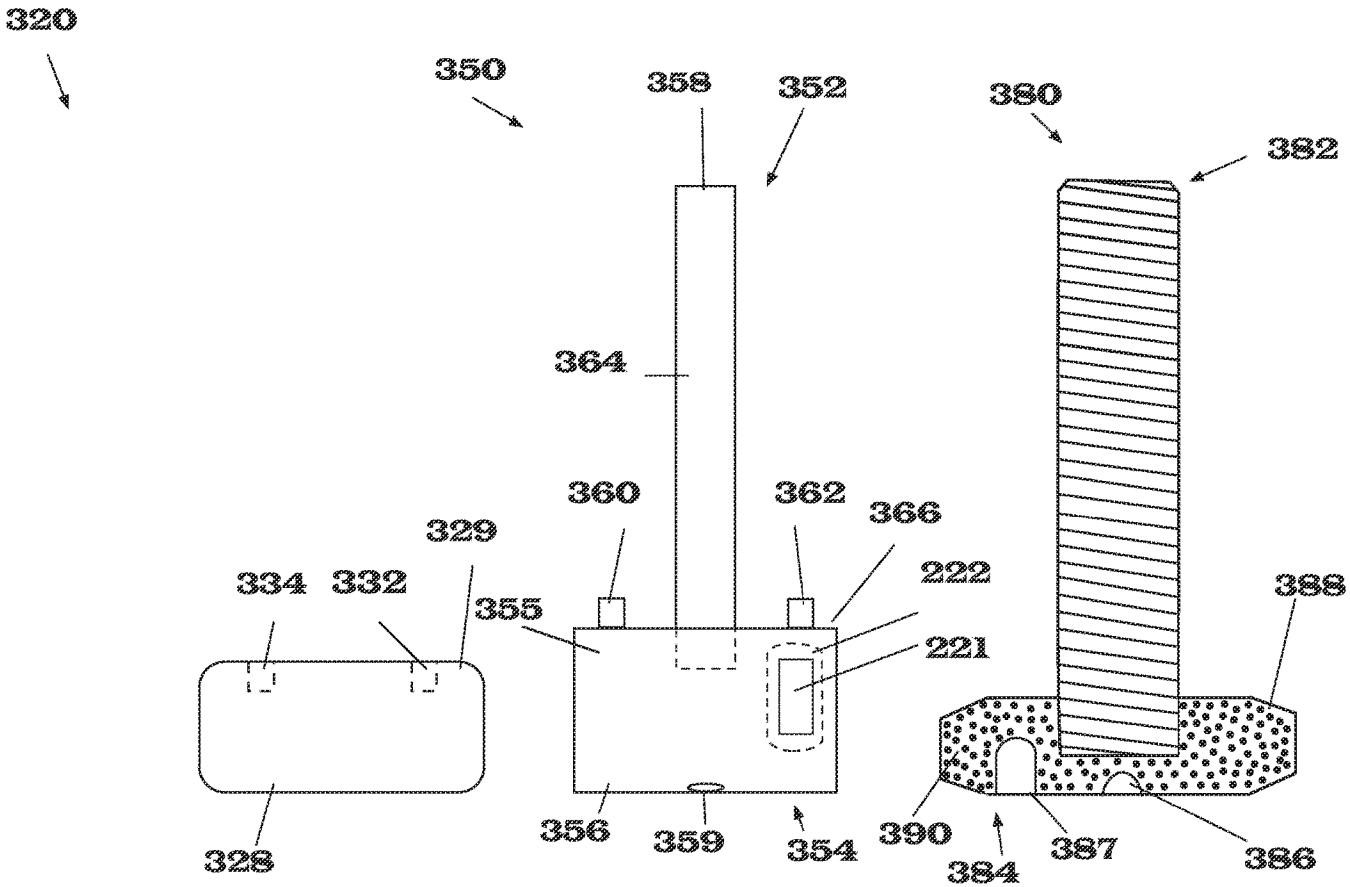
FIG. 10 is a front view of three alternative embodiments of a stud in accordance with the principles of the invention.

FIG. 10 is an alternative embodiment, in accordance with the principles of the invention, showing three different interchangeable studs 320, 350 and 380. In this embodiment, the stud 320 has a proximal end 329 and a distal end 328. The proximal end 329 has two receiving holes 334 and 332. The elongate handle 320 does not have a rod or any structures preventing longitudinal movement.

In this embodiment, the stud 350 has a proximal region 352 and a distal region 354. The rod 364 is located at the proximal region 352 and has a smooth exterior. When the proximal end 358 of the rod 364 engages with the bore 240 of the elongate handle 230 this creates a friction fit. The end cap 355 is located at the distal region 354. The end cap 355 has a proximal end 336 and a distal end 356. Located at the proximal end 366 are dowels 360 and 362. The end cap 355 has a laser 359 located at the distal end 356 that emanates a laser beam where the beam points in a distal direction. This feature may assist the user in form and accuracy when training. This embodiment has an internal cavity 222 with an electronic 221 located inside of the cavity. The electronic may be a sensor package, a speaker or a light.

In this embodiment, the stud 380 has a proximal region 382 and a distal region 384. The end cap 388 is located at the distal region 384. The end cap 388 has grooves 387 and 386 and a grip-like, non-slip coating 390. Optionally, the end cap may have fingertip-like depressions, knurls, or other mechanisms that improve gripping of the end cap 388.

Figure 5:
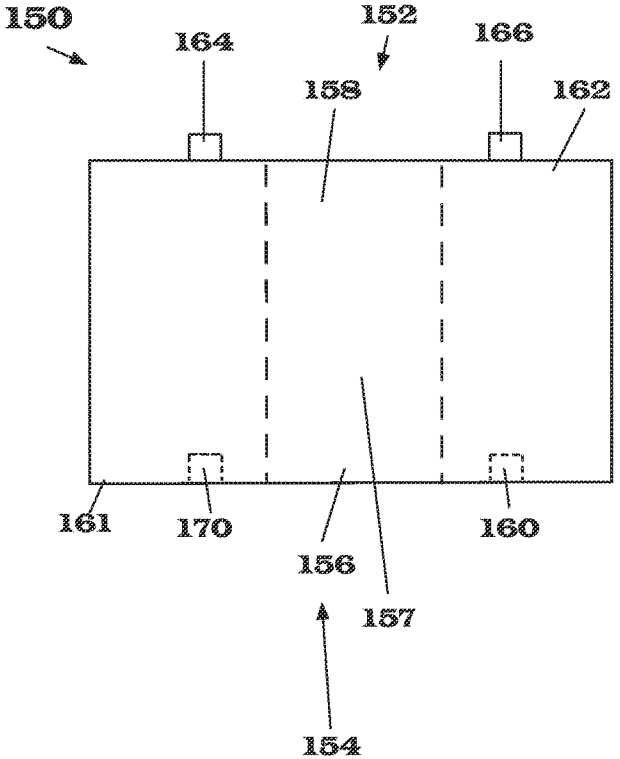
FIG. 5 is a side elevation view of a weight in accordance with the principles of the invention.

FIG. 5 shows an embodiment of a weight 150 in accordance with the principles of the invention. The weight has a proximal region 152 and a distal region 154. The weight has a centrally located bore 157 extending between a first opening 158 at the proximal end 162 to a second opening 156 on the distal end 161. The proximal end 162 of the weight 150 has two dowels 164 and 166. The dowels 164 and 166 are configured to fit into the receiving holes of a second weight as well as the receiving holes 28 and 29 at the distal end 34 of the elongate handle 25. When the dowel and receiving, hole engage this creates a friction fit that prevents rotational movement. The distal end 161 has two receiving holes 170 and 160, configured to fit with the dowels of a second weight. In this embodiment, rotational movement is prevented with dowels 164 and 166 and receiving holes 170 and 160. Optionally, the mechanism used to secure the weight 150 may be by a bayonet locking system or any other suitable mechanism.

Figure 7:
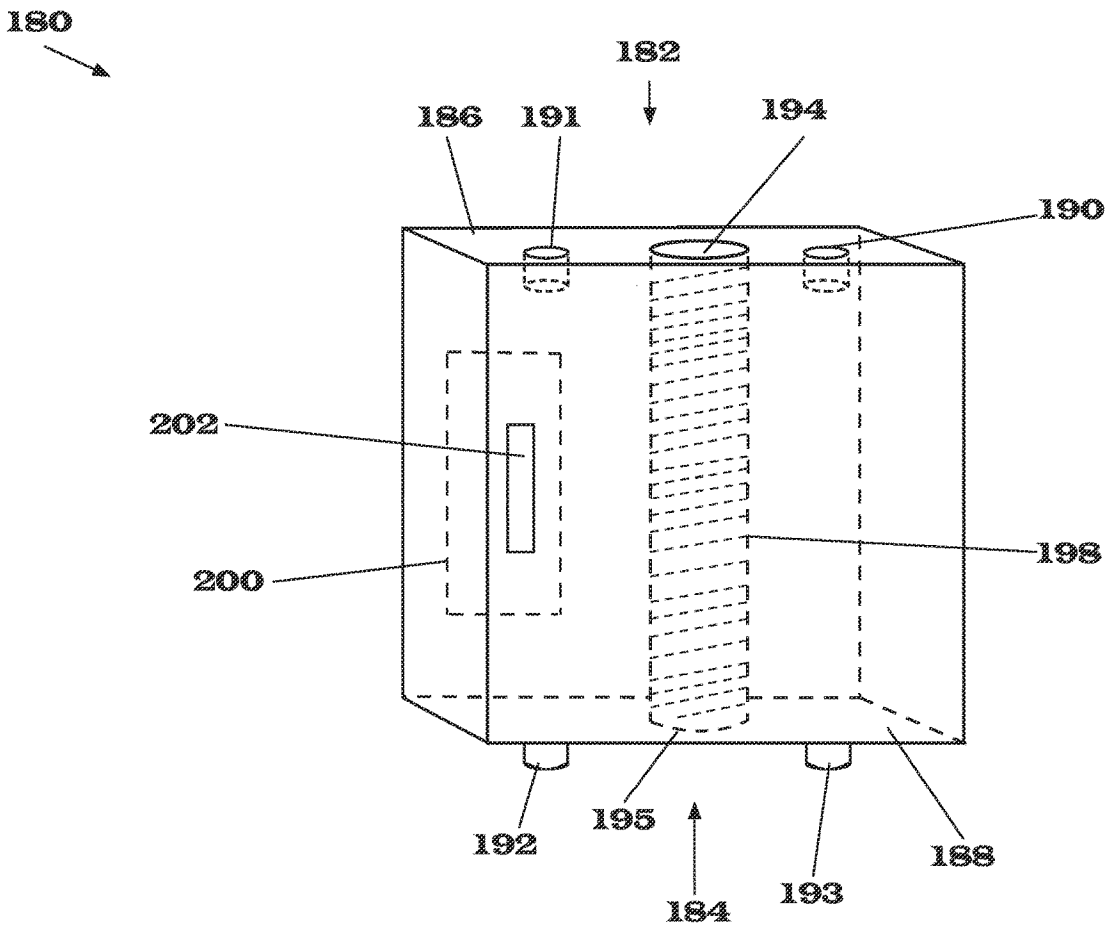
FIG. 7 is an isometric view of an alternative embodiment of a weight in accordance with the principles of the invention.

FIG. 7 shows an alternative embodiment of a weight 180 in accordance with the principles of the invention. The weight 180 is cuboid having a proximal region 182 and a distal region 184. In this embodiment, the dowels 192 and 193 are located at the distal end 188 of the weight 180 and the receiving holes 191 and 190 are located at the proximal end 186 of the weight. The weight 180 has a centrally located threaded bore 198 extending from a proximal opening 194 to a distal opening 195. This embodiment has one cavity 200. Optionally, there may be more than one cavity within the weight. The cavity of this embodiment has an electronic 202. Optionally, the electronic 202 may be a sensor package to collect data about the user and the users progress during training or an electronic having a speaker for sound or light. This may be useful for listening to instruction or music while using the club. This may also be used to provide feedback for the user during routine practice with the club.

Figure 8:
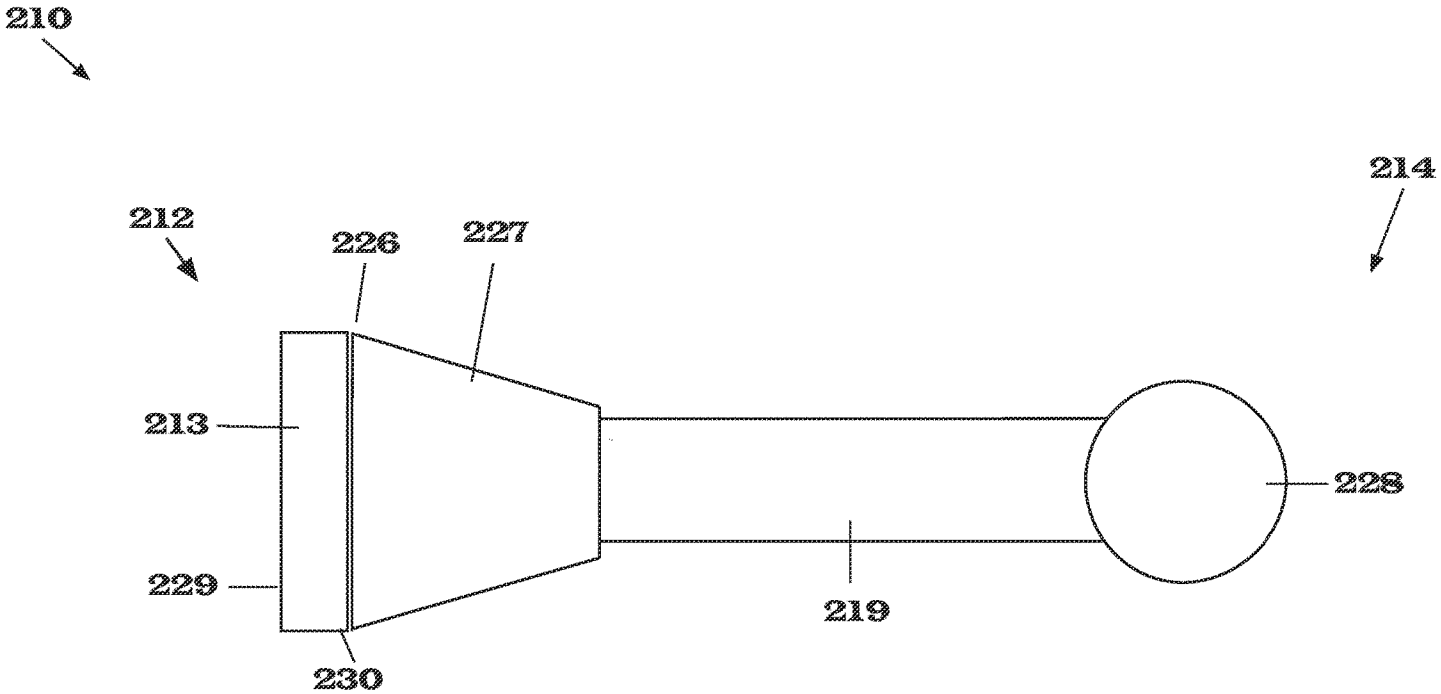
FIG. 8 is a front view of an alternative embodiment of an adjustable club in accordance with the principles of the invention.

FIG. 8 shows another embodiment where the adjustable club 210 has a proximal region 214 and a distal region 212. The distal region 212 has a stud 213 having a distal end 229 and a proximal end 230. The elongate handle is located at the proximal region 214 having a distal end 227 and a proximal end 228. The distal end 227 of the elongate handle 219 lies flush 226 with the proximal end 230 of the stud 213. This embodiment, shows only one removable elongate handle 219 at the proximal region 214 and only one removable stud 213 at the distal region. Optionally, the elongate handle 219 may be interchanged with an alternative elongate handle of a different weight increment. Optionally, the stud 213 may be interchanged with an alternative stud of a different weight increment or may not be weighted at all. This embodiment resembles a scepter.

In use, the embodiment of FIG. 2 is griped by one or both hands at the proximal end 18 of the elongate handle 16 and swung in a strategic sequence for the purpose of art or with the intention to improve physical fitness or skeletal alignment. For example, a user may hold the club at the elongate handle 76 with both hands, swing the adjustable club 70 over either shoulder and allow the club to touch and hang over the shoulder as the even weight distribution causes a steady downward pull on the user's body. Once the user has the proper form, the user may execute a traditional squat while at the same time focusing on titling their pelvis forward and keeping their back straight. This use may be repeated as many times as necessary to achieve the user's fitness objective. This use of the Adjustable Club promotes proper skeletal alignment as well as strength. In this embodiment, the weight of the club is proportionally distributed and the addition of each weight 94,96,98 and 100 distally downshifts the center of gravity.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. An adjustable club comprising:

an elongate handle, defined by a proximal end and a distal end, having an opening to a bore at the distal end;

a stud, having an end cap at a distal end of the stud and a rod at a proximal end of the stud configured to engage the bore of the elongate handle;

one or more weights having a centrally located bore extending between a first opening and a second opening, configured to accommodate the stud;

wherein each of the one or more weights has one or more dowels protruding from a proximal side and one or more receiving holes on a distal side, the one or more receiving holes configured to engage the one or more dowels protruding from another of the one or more weights, thereby preventing the one or more weights from rotating relative to one another;

wherein the distal end of the elongate handle has a frustoconical configuration and tapers outward in a distal direction;

wherein the elongate handle further comprises at least one receiving hole, configured to engage the one or more dowels of one of the one or more weights, thereby preventing the one or more weights from rotating relative to the elongate handle;

wherein a proximal end of the rod engages the centrally located bore the one or more weights and the bore of the elongate handle having a friction fit that prevents rotational movement;

wherein the bore of the elongate handle is a threaded bore and the rod of the stud is configured to engage the threaded bore having a frictional fit that prevents longitudinal and rotational movement; and wherein the proximal end of the elongate handle is a counterweight with a weight equal to a weight of one of the one or more weights such that the center of gravity is down shifted by fifty percent along a longitudinal axis of the elongate handle.

2. The adjustable club of claim 1 wherein the one or more weights comprise a plurality of weights where all of the plurality of weights have a weight equal to the counterweight so that when one of the plurality of weights is added to the elongate handle the center of gravity is down shifted by fifty percent from the handle.

3. The adjustable club of claim of claim 1 wherein the adjustable club is manufactured from a group consisting of a metal, wood, carbon fiber and plastic.

4. The adjustable club of claim 1 wherein the end cap is made from a group consisting of rubber, plastic, and foam.

5. The adjustable club of claim 1, wherein the one or more weights comprise an internal cavity wherein the internal cavity further comprises an electronic from a group consisting of a sensor package, a speaker and a light.

6. The adjustable club of claim 1, wherein the end cap further comprises a laser than emanates a laser beam in a distal direction.

7. The adjustable club of claim 1, wherein the end cap further comprises a grip.

8. The adjustable club of claim 1, wherein the elongate handle further comprises a grip.

* * * * *